US006413361B1

(12) United States Patent
Hino et al.

(10) Patent No.: US 6,413,361 B1
(45) Date of Patent: Jul. 2, 2002

(54) HEAVY OIL EMULSIFIED FUEL EVAPORATOR SYSTEM AND OPERATION METHOD THEREOF

(75) Inventors: Hirokazu Hino; Kimishiro Tokuda; Toshimitsu Ichinose; Katsuyuki Ueda, all of Nagasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/078,658

(22) Filed: May 14, 1998

(30) Foreign Application Priority Data

Oct. 8, 1997 (JP) ..... 9-275796

(51) Int. Cl.[7] ..... B01D 1/00; C10L 1/32

(52) U.S. Cl. ..... 159/44; 44/301; 44/903; 44/904; 159/23; 159/46; 159/47.1; 159/900; 196/132; 196/141; 210/774

(58) Field of Search ..... 203/2, 21, 22, 203/1, 25–27, 100, DIG. 8; 110/189, 190; 202/160, 176; 44/301, 903, 904; 210/774; 196/132, 141, 140; 159/23, 44, 47.1, 46, 900; 73/587

(56) References Cited

U.S. PATENT DOCUMENTS

| | | | | | |
|---|---|---|---|---|---|
| 3,724,484 | A | * | 4/1973 | Turman | 73/24 |
| 4,460,328 | A | * | 7/1984 | Niederholmeyer | 431/11 |
| 4,573,911 | A | * | 3/1986 | Kimmich | 432/179 |
| 4,935,209 | A | * | 6/1990 | Pfoutz | 203/99 |
| 5,443,695 | A | * | 8/1995 | Yuan | 202/160 |
| 5,816,790 | A | * | 10/1998 | Ichinose et al. | 431/11 |
| 5,906,714 | A | * | 5/1999 | Gramkow et al. | 203/2 |

FOREIGN PATENT DOCUMENTS

| | | | |
|---|---|---|---|
| JP | 61-10009 | * | 1/1986 |
| JP | 6146201 | * | 3/1986 |
| JP | 3111606 | * | 5/1991 |

* cited by examiner

*Primary Examiner*—Virginia Manoharan
(74) *Attorney, Agent, or Firm*—Wenderoth, Lind & Ponack, L.L.P.

(57) ABSTRACT

A heavy oil emulsified fuel evaporator system is provided in which a heavy oil emulsified fuel, after being preheated at a preheater, flows into an evaporator to be heated and then to a separator for separation of its water content. The water content, after being separated, is used as a preheating source medium for said preheater, wherein water content separation at a predetermined level is enabled irrespective of load change in a heavy oil fuel combustion equipment, and no light oil content is discharged together with the separated water content. Heavy oil emulsified fuel 11*a* is preheated at a preheater 13, is heated at an evaporator 14 and flows into a separator 15 to be separated of its water content. Water content, after being separated, is sent via a piping 15*a* to be used as the preheating source medium for the preheater 13. Inlet temperature of the evaporator 14 is maintained constant, and pressure in the piping 15*a* for leading the preheating source medium into the preheater 13 is also maintained constant. Further, temperature difference of outlet temperature relative to the inlet temperature of the evaporator 14 is maintained constant. Thereby, the water content in the heavy oil fuel coming out of the separator 15 can be maintained at a predetermined value.

11 Claims, 5 Drawing Sheets

HEAVY OIL EMULSIFIED FUEL EVAPORATOR SYSTEM AND OPERATION METHOD THEREOF

BACKGROUND OF THE INVENTION

1. Field of the Invention

The present invention relates to an evaporator system for separation of water content in a heavy oil emulsified fuel by way of heating, and an operation method thereof.

2. Description of the Prior Art

As heavy oils of a high consistency nature, in order to make its handling during transportation and storage easier, heavy oil fuel is provided in advance with an appropriate amount of water and surface active agent so as to form what is called a heavy oil emulsified fuel. When this heavy oil emulsified fuel is to be burned in a combustion furnace of a boiler etc., it is desirable to remove water content from the heavy oil emulsified fuel for combustion efficiency.

A prior art evaporator system for separation of water content in the heavy oil emulsified fuel is shown in FIG. 7, and a description will be made thereof. In FIG. 7, numeral 11 designates a tank, in which an emulsified fuel 11*a* is stored. Numeral 12 designates a pump, numeral 13 designates a preheater, numeral 14 designates an evaporator, numeral 15 designates a separator, numeral 16 designates a heating steam supply equipment and numeral 17 designates a pump.

In the evaporator system of FIG. 7 having such equipment and machinery, the emulsified fuel 11*a*, containing water, in the tank 11 is fed into the preheater 13 via the pump 12 and a piping 11*b*. A heat exchanger tube 13*a* is provided within the preheater 13 for flow of heating water or steam, after separated, as a preheating source medium which is described later, and the emulsified fuel 11*a* is filled surrounding the heat exchanger tube 13*a*.

It is to be noted that the preheating source medium and the emulsified fuel 11*a* may flow either on the inside or on the outside of the heat exchanger tube 13*a*.

The emulsified fuel 11*a* outside of the heat exchanger tube 13*a* is preheated to a certain temperature through heat exchange with the preheating source medium and is sent to the evaporator 14 via a piping 13*b*. Within the evaporator 14 are provided a plurality of generating tubes 14*a*, 14*b*, 14*c*, for flow of the preheated emulsified fuel 11*a*.

On the other hand, the emulsified fuel 11*a* is heated by a heating source medium surrounding the generating tubes 14*a*, 14*b*, 14*c*, the heating source medium being a heating steam, for example, which is supplied from the heating steam supply equipment 16 via a piping 16*a*, and the heating source medium of which temperature has been lowered is discharged through a piping 16*b*. Thus, the emulsified fuel 11*a* within the generating tubes 14*a*, 14*b*, 14*c* is boiled to be evaporated and is then sent to the separator 15 via a piping 14*d*.

The emulsified fuel 11*a* fed into the separator 15 is separated into water content (such as steam) (i.e., water portion) and heavy oil fuel. The water content separated from the emulsified fuel 11*a* at the separator 15 is sent to the preheater 13 via a piping 15*a* in a state of heating water or steam to be used as a preheating source which flows in said heat exchanger tube 13*a* of the preheater 13. After its temperature has been lowered, the water content is discharged out of the system via a piping 15*b*.

It is to be noted that a surplus water remaining after the separated water has been taken for said preheating source is extracted outside of the system via an extraction valve 15*c* and a piping 15*d* to be used for an atomizing steam etc. Also, the heavy oil fuel of which water content has been separated at the separator 15 is taken out of the system via a piping 15*e* and a pump 17 to be burned in a combustion system (a boiler, for example) having main equipment, such as a tank, a burner, etc. which are not shown in the figure.

In order to make effective use of the amount of heat input of the heating source medium fed into the evaporator 14, a heat regeneration type is used in which the water content separated from the emulsified fuel at the separator 15 is introduced into the preheater 13 as the preheating source medium so that its heat source is made use of repeatedly, and a design of construction consisting of the preheater 13, the evaporator 14, etc. having a heating area that is compact to the greatest extent possible is employed.

In the prior art evaporator system as described above, it is essential to operate it so as to obtain such a high efficiency water separation so as to bring on a maximum thermal efficiency, a most compact-sized design of equipment and machinery and an always constant predetermined value of water content in the heavy oil emulsified fuel which is obtained after separation.

In the mentioned combustion system (boiler etc.) for burning the separated heavy oil fuel, however, the amount of use of the heavy oil fuel used therein is not always constant but varies unavoidably corroding to load change in the boiler etc. For example, if flow rate of the emulsified fuel is increased from a certain flow rate, because the system is of a closed loop, the amount of the preheating source medium from the piping 15*a* does not increase rapidly resulting in lowering of outlet temperature of the preheater and change of the operation conditions.

Thus, when the amount of the emulsified fuel (hereinafter called a "load") sent to the preheater from the tank 11 changes, because the system employs a heat regeneration type, there occurs a delay in delivery and receipt of heat and temperature in each portion changes. Consequently, water content in the emulsified fuel obtained after separation does not become constant, and as one countermeasure therefor, there is given unavoidably a considerable allowance in the design of heating area in the heat exchanger portion of each component of equipment and machinery.

On the other hand, a small amount of light oil content is mixed in the water content separated at the separator 15, and the preheating source medium in which this light oil content is mixed is used for heat exchange at the preheater 13. When this preheating source medium is discharged in a state of steam (gas) from the preheater 13, the light oil content mixed therein in a state of vapor is condensed soon together with the water content so that the oil content is suspended in the water. The oil content once suspended in the water is hardly separated or removed by a general oil content treatment equipment, and draining thereof into rivers and the like becomes impermissible so that there occurs an obstacle in the operation of the evaporator system.

Further, if there occurs a pressure reduction action in the separator 15, the water content in the emulsified fuel which is heated to a high temperature at the evaporator 14 flashes (evaporizes) rapidly and hardly gets out of the surrounding high consistency heavy oil fuel resulting in a state of bubbles in which the emulsified fuel surrounds the steam gas. As the result, the volume of the fuel increases rapidly to fill the separator 15 or to cause an overflow in the water content separation and extraction pipings, separation performance of the water content is deteriorated rapidly, and a large amount of the oil content is discharged out of the system.

SUMMARY OF THE INVENTION

In view of the problems as mentioned above in the prior art heavy oil emulsified fuel evaporator system, it is an object of the present invention to provide an operation method of a heavy oil emulsified fuel evaporator system. In this method, a heavy oil emulsified fuel, after being preheated at a preheater, is led into an evaporator to be heated and then to a separator for separation of its water content so as to form a water portion and a heavy oil portion. The water content, after being separated, is used as a preheating source medium for said preheater, and is channeled to the preheater to preheat the emulsified fuel. The water content separation to a predetermined level is enabled irrespective of load change in a heavy oil fuel combustion equipment. The pressure of the preheating medium is regulated so as to be maintained constant.

Also, it is an object of the present invention to provide a heavy oil emulsified fuel evaporator system in which a heavy oil emulsified fuel, after being preheated at a preheater, is led into an evaporator to be heated and then to a separator for separation of its water content. The water content, after being separated, is used as a preheating source medium for said preheater, wherein no light oil content is discharged together with the separated water content.

Further, it is an object of the present invention to provide a heavy oil emulsified fuel evaporator system having a separator into which the heavy oil emulsified fuel heated at the evaporator is led for separation of water content. The separator is able to prevent the water content in the emulsified fuel from flashing therein and being discharged out of the system.

In order to attain said object to enable a predetermined water content separation constantly, the present invention provides an improved operation method of a heavy oil emulsified fuel evaporator system. First, emulsified fuel is preheated in a preheater. The outlet temperature of a preheater or inlet temperature of an evaporator is maintained constant by regulating the temperature of the emulsified fuel. Pressure in a preheating source medium supply piping for leading a preheating source medium into said preheater is maintained constant. The preheated emulsified fuel, is heated in an evaporator, and the temperature difference of an outlet temperature relative to the inlet temperature of the evaporator (evaporator differential pressure) is regulated so as to be maintained constant. The heated emulsified fuel is then separated as discussed above, and the pressure of the preheating medium is regulated.

In case of load change, flow rate of the emulsified fuel flowing into the preheater is increased or decreased, and the temperature, pressure and flow rate at each of the above-mentioned portions change corresponding thereto. However, by employing the above operation control method of the present invention, a rapid change in the inlet temperature and outlet temperature of the evaporator, and the pressure of the preheating source medium in a piping is avoided so as to be suppressed into a slow change. As the result, change in the water content remaining in the heavy oil fuel after being separated of its water content is avoided, and even in the case of load change, the operation to control the water content to a substantially constant and stable level becomes possible in the entire evaporator system as well.

In the evaporator system to which said operation method is applied, it is desirable to employ a buffer portion for storing the emulsified fuel of an increasable amount, as preheated, in the preheater or between the preheater and the evaporator. With this construction wherein the constant temperature emulsified fuel of the increasable amount is stored in advance, even in the case of a load change, the emulsified fuel of a predetermined temperature can be supplied into the inlet of the evaporator, and the water content in the heavy oil fuel separated thereby can be maintained at a predetermined value constantly.

Also, in order to attain said object to discharge no light oil content together with the separated water content, the present invention provides an improved heavy oil emulsified fuel evaporator system. This system comprises a preheater for preheating the heavy oil emulsified fuel of which water content is to be separated. The preheater is constructed of a first heat exchanger using steam as the preheating source medium and having a level switch, and a second heat exchanger communicating with the first exchanger via the flow control valve and using hot water as the preheating source medium so that the heavy oil emulsified fuel to be preheated flows to the first heat exchanger from the second heat exchanger.

The temperature of the preheated emulsified fuel can be regulated by detecting the temperature of the fuel from the preheater, and by controlling the operation of a preheating medium flow control valve. The evaporator differential temperature can be regulated by detecting the temperature of the fuel from the evaporator, and by controlling the operation of a heating steam flow control valve. The preheating medium temperature can be regulated by detecting the pressure of the preheating medium from the separator, controlling the operation of an auxiliary steam flow control valve, and controlling the operation of an extraction steam flow control valve.

According to this evaporator system of the present invention, the preheating source medium is the steam and high temperature hot water in the first preheater, and the high temperature hot water and low temperature hot water in the second preheater. Consequently, evaluation of heat transfer characteristics in the respective preheater becomes facilitated. Thus, by employing a heat exchanger mainly for steam and a heat exchanger mainly for hot water, individual design with a high accuracy becomes possible, and a compact-sized structure and a reduced cost can be attained.

Further, in the system of piping wherein the hot water level in the preheater is detected and controlled, such an operation control as causes a small volume of hot water to flow so that the flow velocity of the preheating source medium in the state of steam does not reach a critical velocity can be done easily. According to such an operation control, a suspended state of the light oil content in the preheating source medium can be avoided, a subsequent oil content removal by a usual oily water separating equipment can be done easily, and drainage into rivers and the like becomes possible.

Also, in order to attain said object to prevent the water content in the emulsified fuel from flashing in the separator and being discharged out of the system, the present invention provides an improved heavy oil fuel emulsified fuel evaporator system. This system comprises a separator into which the heavy oil emulsified fuel flows after being heated, and the separator has a plurality of opening portions in an upward and downward direction in its side wall. A transmitter for transmitting a sound wave and a receiver for receiving said sound wave are provided for said opening portions.

By employing such a separator as so constructed, bubble generation phenomena in the separator can be detected continuously in advance. Therefore, discharge of the heavy oil fuel out of the system due to overflow can be prevented. Also, by a spreading energy of the sound wave, a defoaming effect can be expected.

DESCRIPTION OF THE PREFERRED EMBODIMENTS

Figure 5:
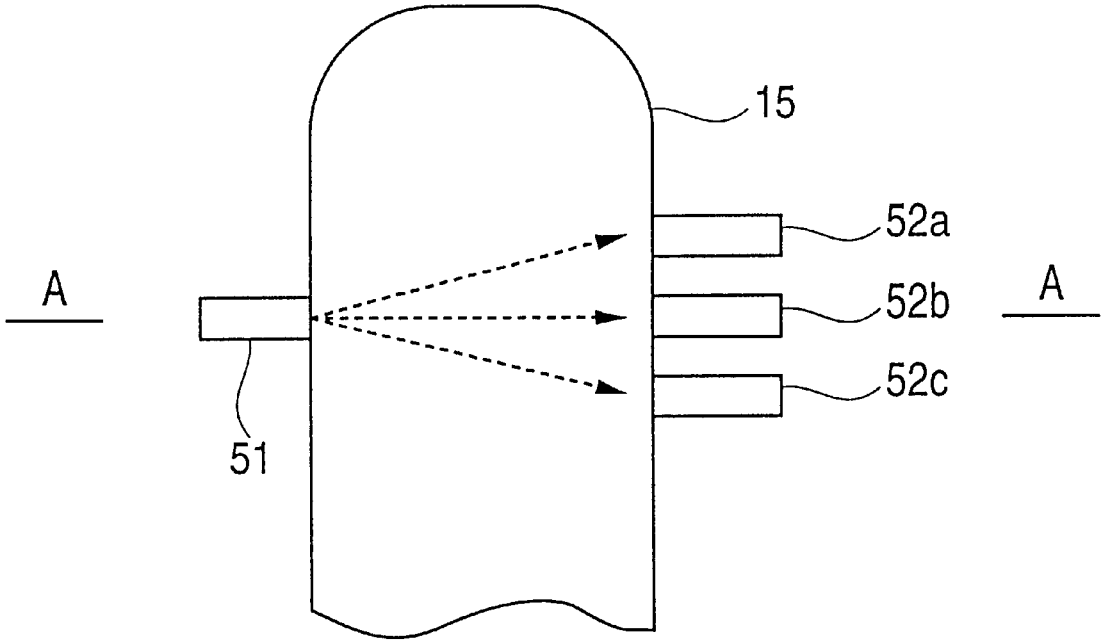
FIG. 5 is an explanatory view showing a construction of a separator to be used for an evaporator system according to a fourth embodiment of the present invention.
Figure 6:
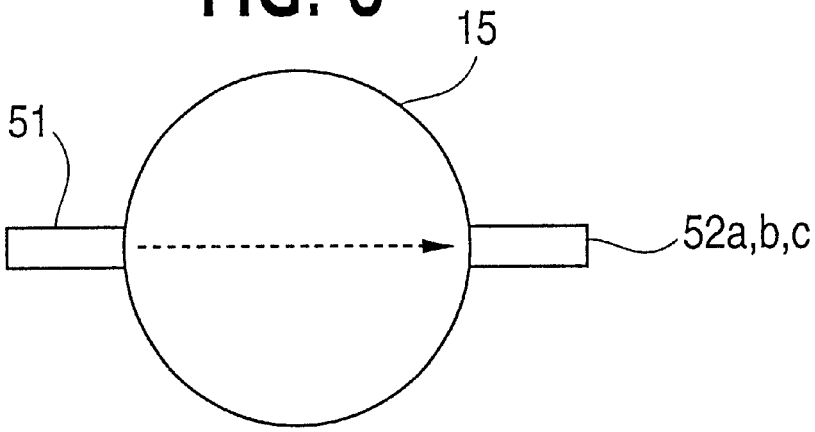
FIG. 6 is a cross sectional view taken along line A—A of FIG. 5.
Figure 7:
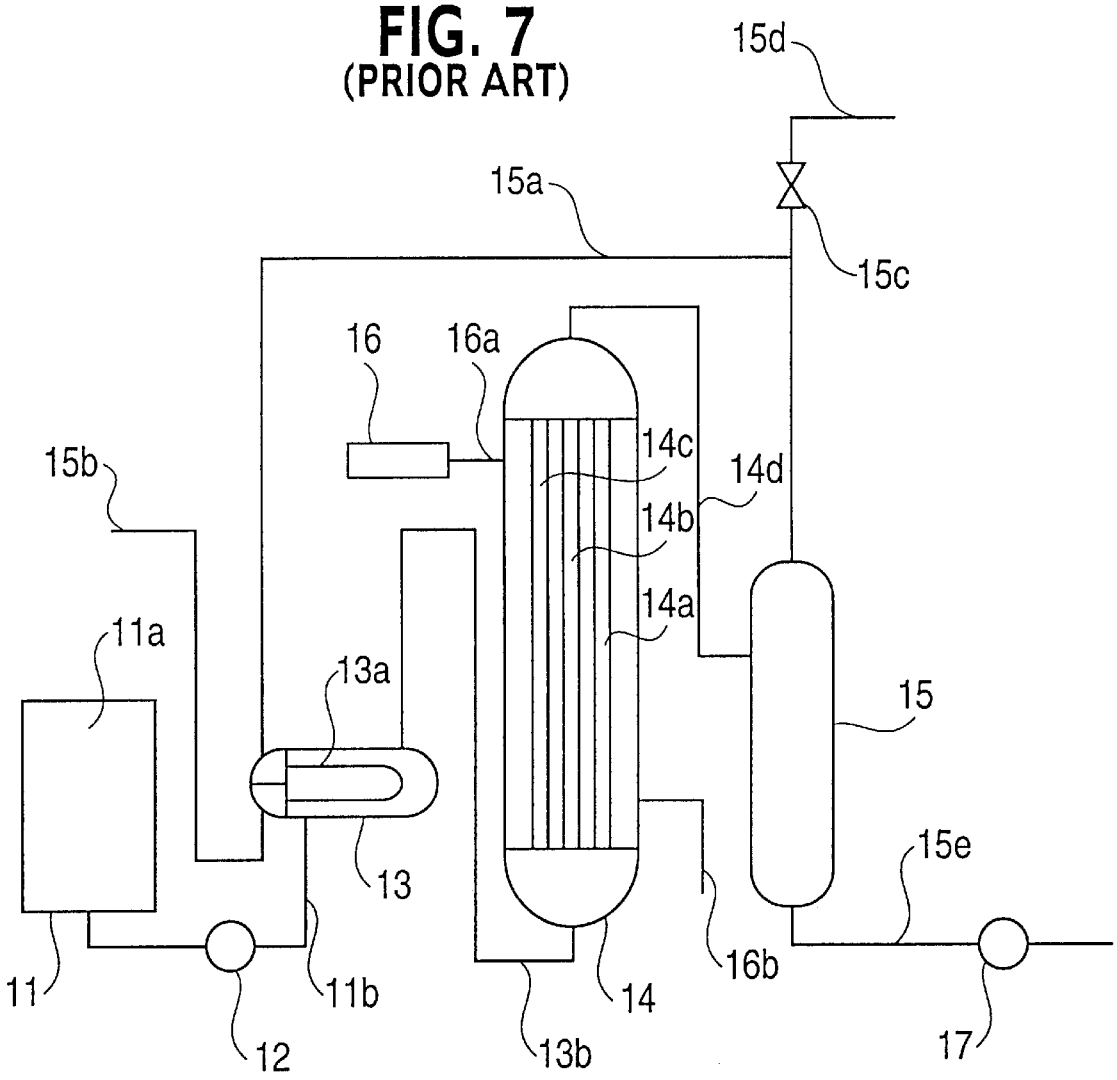
FIG. 7 (PRIOR ART)
FIG. 7 is a diagrammatic view showing a construction of a prior art evaporator system.

Herebelow, description will be made concretely of a heavy oil emulsified fuel evaporator system according to the present invention as well as of an operation method thereof, based on embodiments shown in FIGS. 1 to 6. It is to be noted that, in the embodiments below, the same construction portion as that shown in FIG. 7 is given a same numeral for simplicity of explanation.

(First Embodiment)

Figure 1:
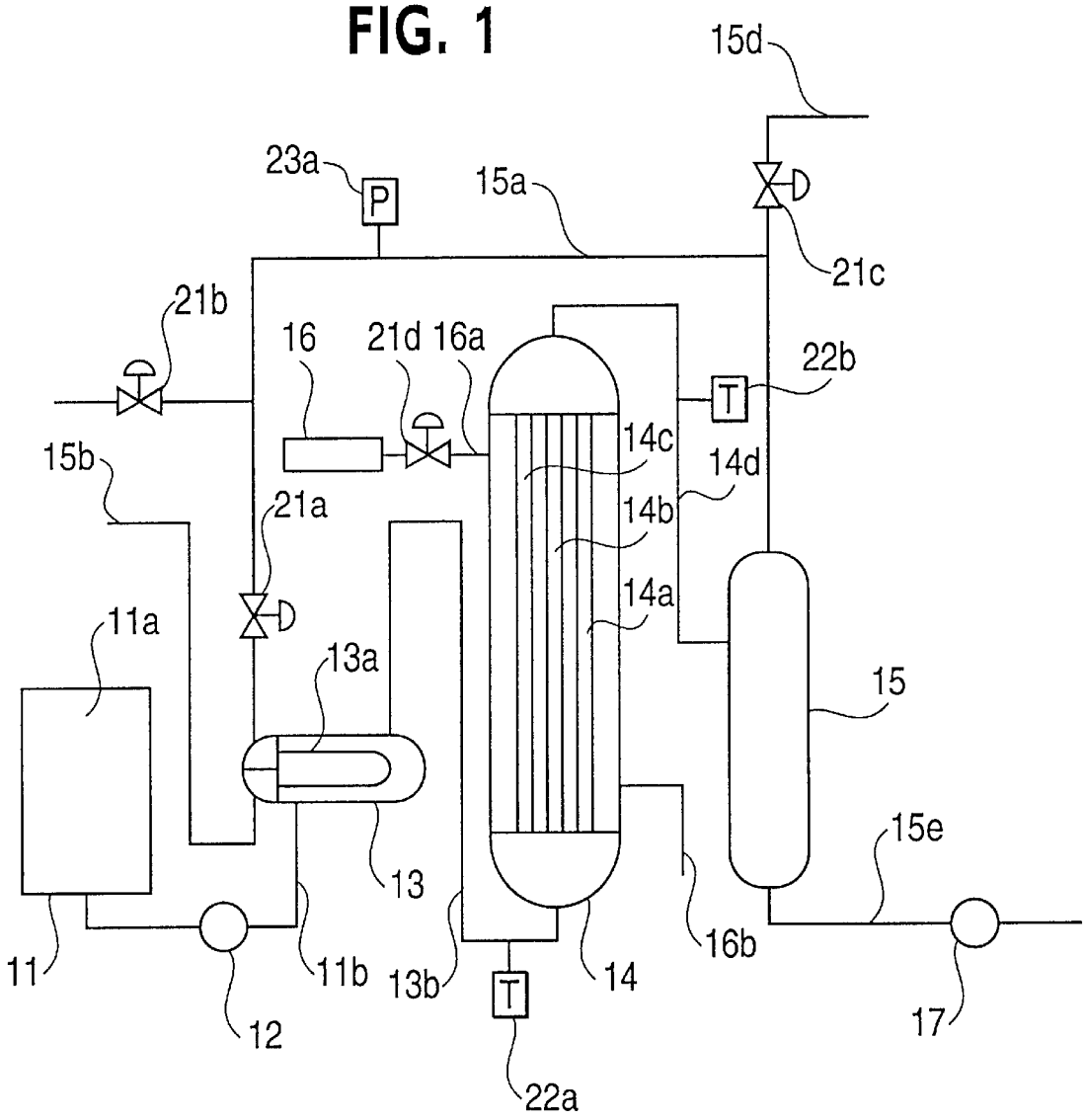
FIG. 1 is a diagrammatic view showing a construction of an evaporator system according to a first embodiment of the present invention.
Figure 2:
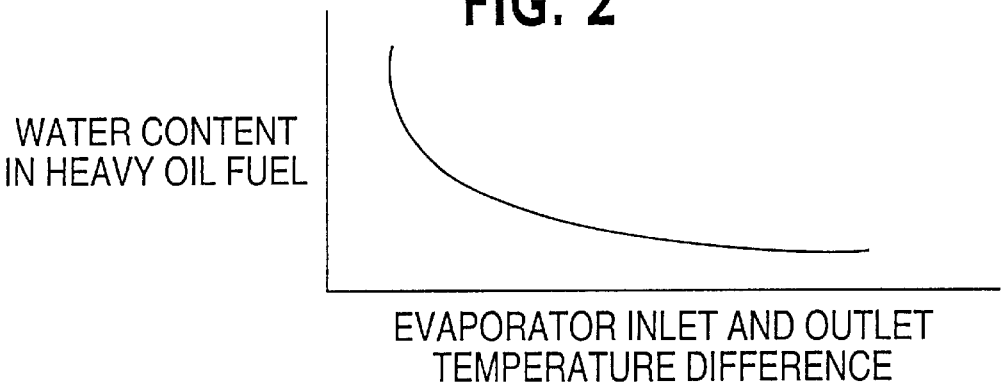
FIG. 2 is a graph showing a relationship between the difference in evaporator inlet and outlet temperatures and water content in a heavy oil emulsified fuel after separation of its water content.

Firstly, an embodiment of an operation method of an evaporator system according to the present invention will be described with reference to FIG. 1. In FIG. 1, numeral 21*a*, 21*b*, 21*c* and 21*d*, respectively, designates a flow control valve, numeral 22*a* and 22*b*, respectively, designates a flow control valve, numeral 22*a* and 22*b*, respectively, designates a temperature sensor and numeral 23*a* designates a pressure sensor. The flow control valve 21*a* is provided in a piping 15*a* for introducing a separated water content to a preheater 13 from a separator 15, and the flow control valve 21*b* is provided in a piping for introducing steam to the piping 15*a* from an auxiliary steam source which is not shown in the figure.

Also, the flow control valve 21*c* is provided in a piping 15*d* and the flow control valve 21*d* in a piping 16*a*. On the other hand, the temperature sensor 22*a* is provided in a piping 13*b* either at the outlet of the preheater 13 or at inlet of an evaporator 14, and the temperature sensor 22*b* is provided in a piping 14*d*. Also, the pressure sensor 23*a* is provided in a piping 15*a*. Other construction is substantially the same as that of the evaporator system shown in FIG. 7.

The flow control valve 21*a* controls (i.e., regulates) the flow rate of the water content (steam) as a preheating source medium which is separated at the separator 15 and is introduced into the preheater 13. Value 21*a* is opened and closed by a signal from the temperature sensor 22*a*, provided either at the outlet of the preheater 13 or at the inlet of the evaporator 14, so as to control (i.e., regulate) the flow rate of the preheating source medium flowing into the preheater 13 to maintain a constant level of outlet temperature of the preheater 13 or of inlet temperature of the evaporator 14. Further, the flow control valve 21*d* is opened and closed by a signal from the temperature sensor 22*b* provided at the outlet of the evaporator 14 so as to control (i.e., regulate) the flow rate of a heating steam to maintain a predetermined constant level of outlet temperature of the evaporator 14.

On the other hand, the flow control valve 21*b*, receiving a signal from the pressure sensor 23 *a* in the piping 15*a* through which the preheating source medium flows, regulates the flow rate of the steam from the auxiliary steam source (not shown) so as to maintain a constant pressure in the piping 15*a*. Also, the flow control valve 21*c* controls the flow rate to be extracted outside of the system of the separated steam as the preheating source medium generated at the separator 15 and flowing in the piping 15*a* so as to maintain a constant pressure in the piping 15*a*.

As mentioned above, the outlet temperature of the preheater 13 (or the inlet temperature of the evaporator 14) is detected and the flow control valve 21*a* is opened and closed so as to maintain (regulate) this temperature constant, thereby the flow rate of the preheating source medium at the inlet of the preheater 13 is controlled. Further, the pressure in the piping for supplying the preheating source medium is detected by the pressure sensor 23*a* and, based on the signal from the pressure sensor 23*a*, the flow control valves 21*b* and 21*c* are opened and closed so as to maintain the constant pressure. Thus, with the constant supply pressure of the preheating source medium and the constant inlet temperature of the evaporator 14, the operation control is facilitated.

In the operation control state with the constant inlet temperature of the evaporator 14, the outlet temperature of the evaporator 14 is controlled to a predetermined temperature. Therefore, the difference between the evaporator inlet temperature and the evaporator outlet temperature (i.e., the evaporator differential temperature) will also be constant. Thus, as is clear from a temperature relationship shown in FIG. 2, such an operation control as controls the water content in the heavy oil fuel to a desired value is realized, and a constant and stable operation of the entire system becomes possible as well.

Furthermore, in case of load change, the flow rate of the emulsified fuel flowing into the preheater 13 is increased or decreased and the temperature, pressure and flow rate at each of the above-mentioned portions change corresponding thereto. However, by employing the operation control method as mentioned above, a rapid change in the inlet temperature and outlet temperature of the evaporator 14 and the pressure of the preheating source medium in the piping 15*a* is avoided so as to be suppressed into a slow change. As the result, change in the water content remaining in the heavy oil fuel after being separated of its water content is avoided, and even in the case of load change, the operation to control the water content to maintain a substantially constant and stable level becomes possible in the entire evaporator system as well.

(Second Embodiment)

Figure 3:
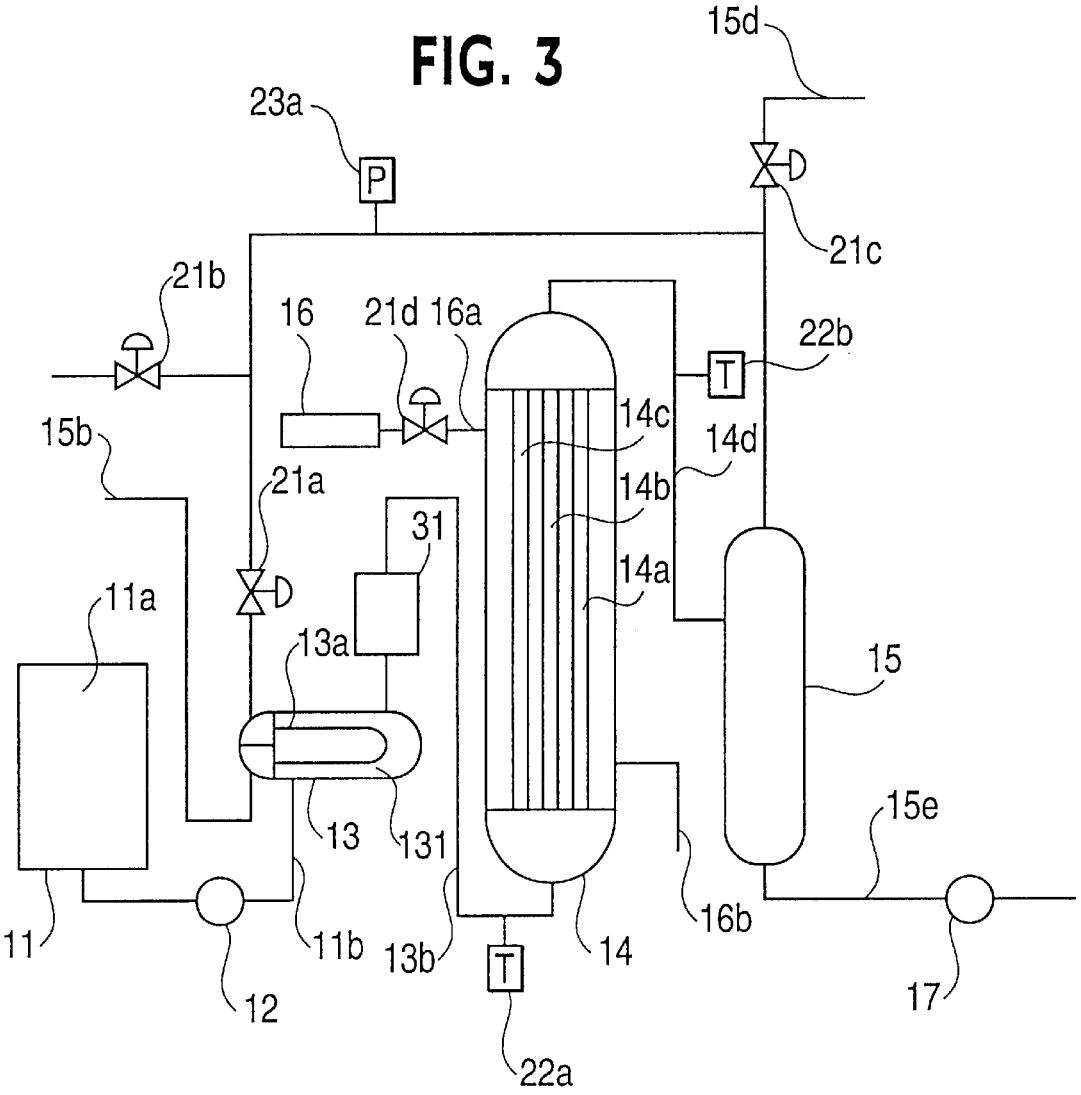
FIG. 3 is a diagrammatic view showing a construction of an evaporator system according to a second embodiment of the present invention.

Next, a second embodiment will be described with reference to FIG. 3. In FIG. 3, numeral 31 designates a buffer tank, which serves as a buffer portion and is provided in a middle of a piping 13*b* for leading an emulsified fuel to an evaporator 14 from a preheater 13.

Alternatively, in place of the buffer tank 31, a preheater 13 having a buffer portion 131 may be provided. The preheater with the buffer portion is constructed so that a volume outside of a heat exchanger tube 13*a* (a portion where the emulsified fuel flows) in the preheater 13 is of an increasable amount. The term "increasable amount" is defined to mean an amount of the emulsified fuel equivalent to at least a one hour supply which can be supplied into the evaporator 14 within a time period of load changes.

Other construction than the above is substantially the same as that of the evaporator system shown in FIG. 1 and FIG. 7. In such emulsified fuel evaporator system shown in FIG. 3, the emulsified fuel of the increasable amount which has been preheated controlledly to a predetermined temperature can be stored in advance in the buffer tank 31 or in the preheater 13.

In case of load change, for example load increase, in a combustion system (boiler and the like) for burning the separated heavy oil, rotation of a pump 12 is increased to increase the supply amount of the emulsified fuel into the preheater 13. That is, the flow rate of the emulsified fuel to be introduced into the emulsified fuel evaporator system is increased. Because the emulsified fuel of predetermined temperature is stored in advance in the increasable amount, the temperature of the emulsified fuel flowing into the inlet of the evaporator 14 is always maintained constant within the range of time of the load change.

Thus, the flow rate of heating steam as a heating source medium to be supplied into the evaporator 14 is controlled so as to maintain the outlet temperature of the evaporator 14 at a predetermined level. Consequently, a heavy oil fuel supply having a predetermined amount of water content after separation of its water content (that is, the heavy oil fuel having a predetermined amount of water content irrespective of increase or decrease in the flow rate of the heavy oil fuel to be supplied into the combustion system) can be attained easily along the relationship shown in FIG. 2.

In the evaporator system of the second embodiment as mentioned above, the emulsified fuel of predetermined temperature in the increasable amount is stored in advance in the buffer tank 31 or in the preheater 13. Hence, even in such an operation as cannot avoid a load change operation or in such an operation state within a time range while the supply amount of the emulsified fuel to the preheater 13 increases or decreases, the inlet temperature of the evaporator 14 is always maintained constant and by controlling the outlet temperature of the evaporator 14 to a predetermined temperature, the water content in the heavy oil fuel after separation of its water content can be controlled to a predetermined value easily.

(Third Embodiment)

Figure 4:
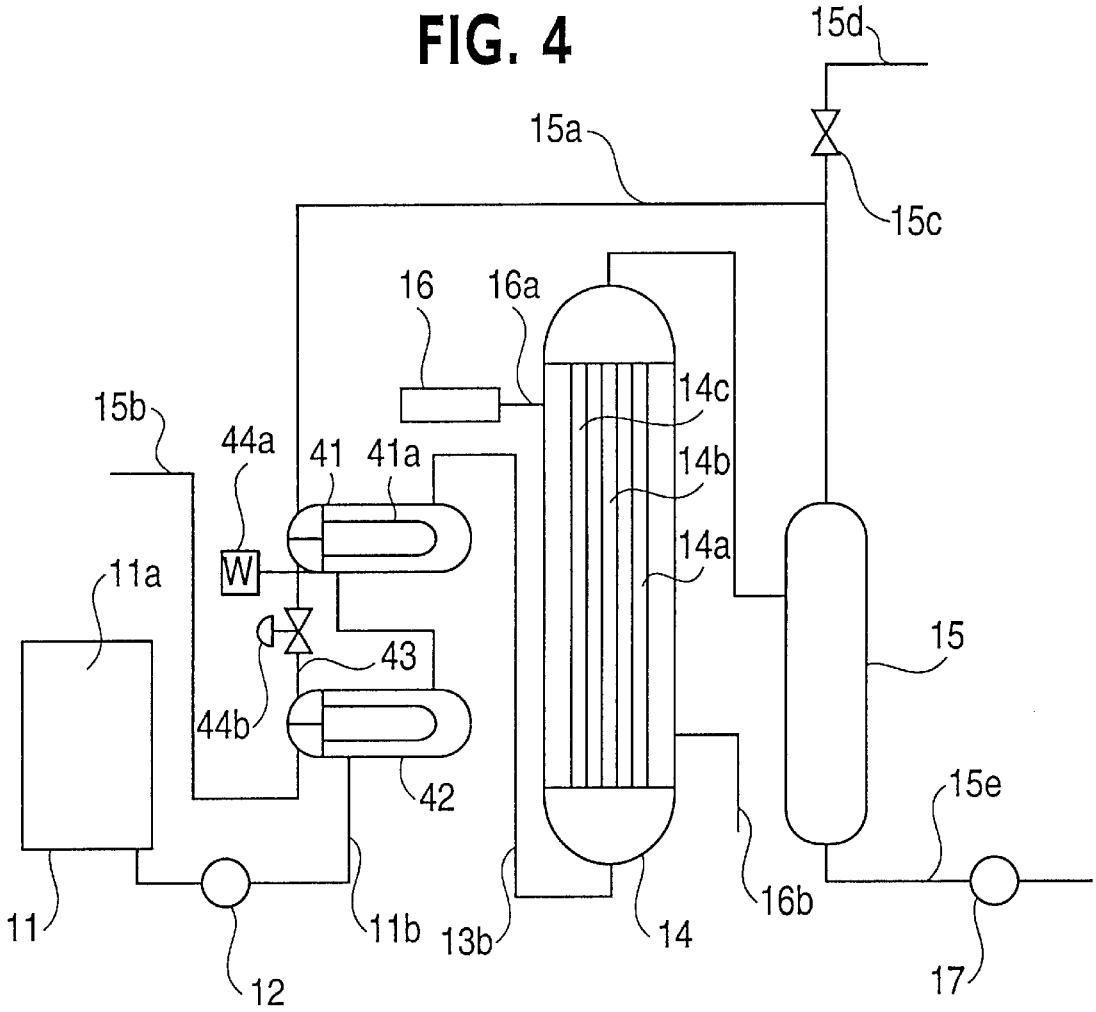
FIG. 4 is a diagrammatic view showing a construction of an evaporator system according to a third embodiment of the present invention.

Next, an emulsified fuel evaporator system of a third embodiment according to the present invention will be described with reference to FIG. 4. In this evaporator system of the third embodiment, preheaters 41 and 42 in two-stages or more are provided in place of the preheater 13 in FIG. 1. It is to be noted that the preheaters 41 and 42 may be of a single unit of preheaters or a parallel arrangement of plural pieces. Also, a level switch 44*a* and a control valve 44*b* of a preheating source medium are provided to the preheater 41.

The preheaters 41 and 42 have such a heating area and structure so as to provide the following functions in terms of heating characteristics. That is, an operation is controlled such that the water level of the preheating source medium in the preheater 41 is controlled by the control valve 44*b* opened and closed by a signal from the level switch 44*a* so that the preheating source medium of steam state may not be introduced into the next preheater 42 from the preheater 41.

As the result, a separated steam from the preheating source medium separated at a separator 15 and sent to the preheater enters first a heat exchanger tube 41*a* in the preheater 41 to change to a hot water state from the steam (gas) state through heat exchange with the surrounding emulsified fuel. The hot water is then introduced into a heat exchanger tube 42*a* of the next preheater 42 likewise to preheat the emulsified fuel and is discharged out of the system via a piping 15*b*.

In the separated steam as the preheating source medium separated at the separator 15, there is mixed a light oil content. If such a case has occurred that flow velocity in the piping has become several tens m/s or more or has reached a critical velocity, the light oil content is suspended in the hot water to be discharged outside of the system from the preheater so that it is hardly removed from the drainage by a usual oily water separating equipment, and drainage into rivers and the like becomes impermissible.

On the other hand, if a single preheater is used, heat utilization must be done such that the preheating source medium changes to a low temperature hot water state from a high temperature steam state in that single preheater. However, because the exchange heat amount changes in proportion to the amount of the emulsified fuel flowing in the preheater, the position of a transition region between steam state and hot water state of the preheating source medium varies.

As heat transfer characteristics between steam and hot water are largely different from each other, if the presence of steam or hot water is unknown in the preheating source medium in the preheater, an accurate design of the heating area will be difficult. This will unavoidably result in a design with a large allowance, which brings on an enlarged structure and an increased cost.

On the contrary, in the present third embodiment, such a heat exchanger is employed that the preheating source medium is the steam and high temperature hot water in the preheater 41, and the high temperature hot water and low temperature hot water in the preheater 42. Thereby, evaluation of heat transfer characteristics in the respective preheater becomes facilitated.

Thus, by employing a heat exchanger mainly for steam and a heat exchanger mainly for hot water, individual design with a high accuracy becomes possible, and a compact-sized structure and a reduced cost can be attained.

Further, in the system of piping wherein the hot water level in the preheater is detected and controlled, a control operation can easily be established to cause a small volume of hot water to flow so that the flow velocity of the preheating source medium in the state of steam is not 10 m/s or more or does not reach a critical velocity. That is, an operation control is done so that the flow velocity in the piping becomes several tens m/s or less, a suspended state of the light oil content in the preheating source medium can be avoided, a subsequent oil content removal by a usual oily water separating equipment can be done easily, and drainage into rivers and the like becomes possible.

(Fourth Embodiment)

A fourth embodiment shown in FIGS. 5 and 6 will be described. FIGS. 5 and 6 show only a separator 15 to be used for an evaporator system of the present invention. The separator 15 shown in FIG. 5 has a structure wherein there are provided at opening portions on a side face thereof a transmitter 51 and receivers 52*a*, 52*b* and 52*c*. Said transmitter 51 and receivers 52*a*, 52*b* and 52*c* may also be provided in a plurality of sets thereof.

If there occurs a pressure reduction action in the separator 15, water content in the emulsified fuel heated to a high temperature at an evaporator flashes (vaporizes) rapidly and hardly gets out of a surrounding high consistency heavy oil fuel. This results in a state of bubbles in which the heavy oil fuel surrounds the steam of gas.

A sound wave is transmitted from the transmitter 51 at the opening portion on a side of the vessel and is received by the receivers 52*a*, 52*b* and 52*c* provided upward and downward at the opening portions in the opposing wall. When the sound wave passes through the separator 15, there are differences in the velocity passing through the air and the heavy oil fuel and steam in the emulsified fuel, and these differences in the receiving time of sound wave are measured and processed by a measuring device and computing device (not shown).

In a normal operation state, the emulsified fuel is separated completely into the water content (steam) and the heavy oil fuel at the separator 15, and there is substantially only the steam in the range where the sound wave is projected (transmitted) from the transmitter 51 resulting in a constant receiving time. On the contrary, if there occur said bubbles, the heavy oil fuel increases in place of the steam resulting in variations in the receiving time of the sound wave. Thus, a continuous prior detection of bubble generation phenomena in an abnormal operation becomes possible, and discharge of the heavy oil fuel out of the system due to overflow can be prevented. Further, by a spreading energy of the sound wave, a defoaming effect can be expected as well.

As described above, according to the operation method of the heavy oil emulsified fuel evaporator system of the present invention, the outlet temperature of the preheater or inlet temperature of the evaporator is controlled constant, pressure in the preheating source medium supply piping for leading the preheating source medium into the preheater is controlled constant, and temperature difference between the inlet temperature and the outlet temperature of the evaporator is controlled constant. Thereby, even in a case of load change, variations in the water content in the heavy oil fuel after separation of water content can be avoided.

Also, in said operation method, a construction for storing the preheated emulsified fuel of the increasable amount in the preheater or between the preheater and the evaporator is employed. Thereby, even in a case of load change, the emulsified fuel of predetermined temperature can be supplied into the inlet of the evaporator and the water content in the heavy oil fuel can be maintained to a predetermined value easily.

Further, the present invention provides a heavy oil emulsified fuel evaporator system in which the preheater for preheating the heavy oil emulsified fuel of which water content is to be separated is constructed of a first heat exchanger using steam as the preheating source medium and having a level switch, and a second heat exchanger communicating with the first exchanger via the flow control valve and using hot water as the preheating source medium. The heavy oil emulsified fuel to be preheated flows to the first heat exchanger from the second heat exchanger.

In said evaporator system the heat exchanger, which is the preheater, is divided into the first heat exchanger using steam and hot water as the preheating source medium, and the second heat exchanger using hot water only as the preheating source medium. Hence, evaluation of the heat transfer characteristics becomes easy, and design of a high accuracy becomes possible. Further, hot water level in the preheater is controlled, so that light oil content in the preheating source medium is prevented from being in a suspended state.

Also, the present invention provides an evaporator system employing a separator having a sound wave component including a transmitter for transmitting a sound wave and a receiver for receiving the sound wave. Thereby, bubble generation phenomena in the separator can be detected in advance continuously, so that discharge of the heavy oil fuel out of the system due to overflow can be prevented.

It is understood that the invention is not limited to the particular construction and arrangement herein illustrated and described but embraces such modified forms thereof as come within the scope of the following claims.

What is claimed is:

1. A method of operating an emulsified fuel evaporator system, comprising:

preheating emulsified fuel in a preheater so as to obtain a preheated emulsified fuel;

regulating a temperature of the preheated emulsified fuel such that the temperature of the preheated emulsified fuel is maintained constant;

heating the preheated emulsified fuel in an evaporator so as to obtain a heated emulsified fuel;

regulating an evaporator differential temperature such that the evaporator differential temperature is maintained constant;

separating the heated emulsified fuel in a separator so as to obtain a water portion and a heavy oil portion, the water portion comprising a preheating medium channeled to the preheater for said preheating of the emulsified fuel;

regulating a pressure of the preheating medium such that the pressure of the preheating medium is maintained constant; and transmitting sound waves through the separator.

2. The method of claim 1, further comprising storing the preheated emulsified fuel in a buffer portion, wherein the buffer portion is located in the preheater or in a piping portion between the preheater and the evaporator.

3. The method of claim 1, wherein said regulating of the temperature of the preheated emulsified fuel comprises:

detecting a temperature of the preheated emulsified fuel from the preheater; and controlling an operation of a preheating medium flow control valve based on the detected temperature of the preheated emulsified fuel so as to control a flow rate of the preheating medium to the preheater.

4. The method of claim 3, wherein said regulating of the evaporator differential temperature comprises:

detecting a temperature of the heated emulsified fuel from the evaporator; and controlling an operation of a heating steam flow control valve based on the detected temperature of the heated emulsified fuel so as to control a flow rate of heating steam to the evaporator.

5. The method of claim 1, wherein said regulating of the evaporator differential temperature comprises:

detecting a temperature of the heated emulsified fuel from the evaporator; and controlling an operation of a heating steam flow control valve based on the detected temperature of the heated emulsified fuel so as to control a flow rate of heating steam to the evaporator.

6. The method of claim 1, wherein said regulating of the pressure of the preheating medium comprises:

detecting a pressure of the preheating medium from the separator;

controlling an operation of an auxiliary steam flow control valve based on the detected pressure of the preheating medium so as to control a flow rate of auxiliary steam into the preheating medium; and controlling an operation of an extraction steam flow control valve based on the detected pressure of the preheating medium so as to control a flow rate of extracted preheating medium from the preheating medium.

7. The method of claim 6, wherein said regulating of the evaporator differential temperature comprises:

detecting a temperature of the heated emulsified fuel from the evaporator; and controlling an operation of a heating steam flow control valve based on the detected temperature of the heated emulsified fuel so as to control a flow rate of heating steam to the evaporator.

8. The method of claim 6, wherein said regulating of the temperature of the preheated emulsified fuel comprises:

detecting a temperature of the preheated emulsified fuel from the preheater; and controlling an operation of a preheating medium flow control valve based on the detected temperature of the preheated emulsified fuel so as to control a flow rate of the preheating medium to the preheater.

9. The method of claim 8, wherein said regulating of the evaporator differential temperature comprises:

detecting a temperature of the heated emulsified fuel from the evaporator; and controlling an operation of a heating steam flow control valve based on the detected temperature of the heated emulsified fuel so as to control a flow rate of heating steam to the evaporator.

10. An emulsified fuel evaporator system comprising:

a preheater including a first heat exchanger using steam as a preheating medium and a second heat exchanger using hot water as a preheating medium, said second heat exchanger communicating with said first heat exchanger through a flow control valve, a level switch being provided at said first heat exchanger for detecting a preheating medium level in said first heat exchanger, said level switch being connected to said flow control valve so as to operate said flow control valve based on the detected preheating medium level, wherein the emulsified fuel is preheated in said preheater by entering said second heat exchanger and flowing from said second heat exchanger to said first heat exchanger;

an evaporator communicating with said preheater such that preheated emulsified fuel flows from said preheater to said evaporator;

a separator communicating with said evaporator such that heated emulsified fuel flows from said evaporator to said separator, said separator being capable of separating the heated emulsified fuel into a water portion and a heavy oil portion, said separator communicating with said preheater so that the water portion comprises the preheating medium used in said preheater; and a sound wave component for transmitting sound waves through said separator.

11. The emulsified fuel evaporator system of claim 10, wherein said sound wave component includes a plurality of openings arranged in a vertical direction along a side wall of said separator, at least one transmitter provided at said openings for transmitting a sound wave, and at least one receiver provided at said openings for receiving the sound wave transmitted by said at least one transmitter.

* * * * *